US011731142B2

(12) United States Patent
Troiano et al.

(10) Patent No.: US 11,731,142 B2
(45) Date of Patent: Aug. 22, 2023

(54) METHODS OF JET MILLING AND SYSTEMS

(71) Applicant: CTL Energy, Inc., Hyde Park, PA (US)

(72) Inventors: Richard Troiano, Hyde Park, PA (US); Cliff Raleigh, Hyde Park, PA (US); Jeffrey Badac, Hyde Park, PA (US)

(73) Assignee: Qwave Solutions, Inc., Hyde Park, PA (US)

( * ) Notice: Subject to any disclaimer, the term of this patent is extended or adjusted under 35 U.S.C. 154(b) by 0 days.

(21) Appl. No.: 17/421,990

(22) PCT Filed: Jan. 7, 2020

(86) PCT No.: PCT/US2020/012522
§ 371 (c)(1),
(2) Date: Jul. 9, 2021

(87) PCT Pub. No.: WO2020/146337
PCT Pub. Date: Jul. 16, 2020

(65) Prior Publication Data

US 2022/0111397 A1 Apr. 14, 2022

Related U.S. Application Data

(60) Provisional application No. 62/790,297, filed on Jan. 9, 2019.

(51) Int. Cl.

| | |
|---|---|
| ***B02C 19/06*** | (2006.01) |
| ***B02C 23/22*** | (2006.01) |
| ***B02C 21/00*** | (2006.01) |

(52) U.S. Cl.
CPC ..... *B02C 23/22* (2013.01); *B02C 19/06* (2013.01); *B02C 19/061* (2013.01); *B02C 19/068* (2013.01); *B02C 21/00* (2013.01)

(58) Field of Classification Search
CPC ..... B02C 19/06; B02C 19/061; B02C 19/068; B02C 23/22
See application file for complete search history.

(56) References Cited

U.S. PATENT DOCUMENTS 3,877,647 A * 4/1975 Gorobets ..... B02C 19/065 241/39
3,973,733 A 8/1976 Switzer
(Continued)

FOREIGN PATENT DOCUMENTS

JP H11-156224 A 6/1999
JP 2002-285208 A 10/2002
(Continued)

OTHER PUBLICATIONS

PCT International Search Report and Written Opinion for PCT Application No. PCT/US2020/0125222 dated Mar. 31, 2020 (10 pages).
(Continued)

*Primary Examiner* — Faye Francis
(74) *Attorney, Agent, or Firm* — Eversheds Sutherland (US) LLP

(57) ABSTRACT

Methods of grinding materials. The methods may include introducing a material and a circulating fluid to a jet mill and recycling the circulating fluid. The material may include coal. Systems of grinding materials also are provided.

18 Claims, 2 Drawing Sheets

(56) References Cited

U.S. PATENT DOCUMENTS

| | | | | |
|---|---|---|---|---|
| 4,504,017 | A * | 3/1985 | Andrews | B02C 19/06 241/40 |
| 4,664,319 | A * | 5/1987 | Andrews | B02C 19/061 241/39 |
| 4,720,049 | A * | 1/1988 | Niemi | B02C 19/06 241/39 |
| 5,111,998 | A * | 5/1992 | Kanda | G03G 9/0817 241/34 |
| 5,915,635 | A | 6/1999 | Cannell et al. | |
| 6,045,068 | A | 4/2000 | Ashbrook | |
| 7,461,799 | B2 * | 12/2008 | Niemi | B02C 19/065 241/39 |
| 8,177,149 | B2 * | 5/2012 | Nied | B02C 19/065 241/5 |
| 8,864,056 | B2 * | 10/2014 | Paulat | C09D 7/42 241/23 |
| 2012/0325942 | A1 | 12/2012 | Lustig et al. | |
| 2013/0341438 | A1 * | 12/2013 | Kozawa | B02C 23/06 241/5 |
| 2014/0334962 | A1 * | 11/2014 | Sun | B02C 23/12 241/39 |
| 2015/0352558 | A1 * | 12/2015 | Lansell | B02C 19/06 422/127 |
| 2016/0303577 | A1 * | 10/2016 | Lansell | B02C 19/06 |
| 2019/0105662 | A1 * | 4/2019 | Harrison | B03B 9/061 |

FOREIGN PATENT DOCUMENTS

| | | | |
|---|---|---|---|
| JP | 2005-029410 | A | 2/2005 |
| WO | 2005044456 | | 5/2005 |
| WO | 2017/042341 | A1 | 3/2017 |

OTHER PUBLICATIONS

First Office Action issued in China application No. 202080019747.5, dated Aug. 1, 2022, 19 pages.

Non-Final Office Action issued in U.S. Appl. No. 17/876,990, dated Sep. 28, 2022, 10 pages.

First Examination Report issued in India application No. 202117035851, dated Mar. 17, 2023, 6 pages.

* cited by examiner

METHODS OF JET MILLING AND SYSTEMS

CROSS REFERENCE TO RELATED APPLICATIONS

This application claims the priority benefit of PCT/US2020/012522, filed on Jan. 7, 2020, which claims priority to U.S. Provisional Patent Application No. 62/790,297, filed Jan. 9, 2019, the entire contents of which are incorporated herein by reference.

BACKGROUND

A jet mill is an apparatus used to reduce the size of particles. Jet mills are generally reliable because they typically do not include moving parts or screens, nor do jet mills typically require the use of any grinding media. A jet mill reduces the size of particles due to high-velocity collisions that occur between the particles injected into a jet mill.

Although jet mills are suitable for grinding a relatively large number of materials, jet mills generally have not been used to grind certain materials, such as coal, due to concerns regarding efficiency, cost, safety, or a combination thereof.

There remains a need for methods and systems for jet milling materials, including coal. There also remains a need for methods and systems of jet milling that are more efficient and/or less costly, including methods that recycle a fluid used in the processes.

BRIEF SUMMARY

Provided herein are methods and systems that may rely on a jet mill to grind a material, including coal. The methods and systems provided herein may include a circulating fluid that forwards (e.g., transports) a material, pressurizes a jet mill, and is recycled. The ability to recycle the circulating fluid may reduce the costs associated with the methods and systems described herein. The circulating fluid may include an oxygen-free fluid, which may improve safety.

In one aspect, methods of jet milling a material are provided. In some embodiments, the methods include disposing in a grinding chamber of a jet mill a first stream that includes (i) a circulating fluid and (ii) particles of a material to produce a second stream that includes (a) the circulating fluid and (b) a ground material, wherein the jet mill is pressurized by the circulating fluid. The second stream then may be forwarded to a cyclone separator, wherein the cyclone separator is configured to separate a first portion of the ground material from a second portion of the ground material, wherein the first portion of the ground material includes particles having a particle size equal to or greater than a threshold particle size, and the second portion of the material includes particles having a particle size less than the threshold particle size. The methods may include collecting the first portion of the ground material in a first collector. The methods may include forwarding to a second collector a third stream that includes (1) the circulating fluid and (2) the second portion of the ground material, wherein the second collector is configured to separate the second portion of the ground material from the third stream to produce a fourth stream comprising the circulating fluid. The methods may include contacting the fourth stream with additional circulating medium and/or additional particles of the material to create a fifth stream.

In another aspect, systems for grinding a material are provided. In some embodiments, the systems include a jet mill configured to reduce an average particle size of a material to produce a ground material, a cyclone separator configured to separate a first portion of the ground material and a second portion of the ground material, wherein the first portion of the ground material includes particles having a size equal to or greater than a threshold particle size, and the second portion of the ground material includes particles having a size less than the threshold particle size, a first collector configured to collect the first portion of the ground material, and a second collector configured to collect the second portion of the ground material, and a compressor. The jet mill may be in fluid communication with the cyclone separator, the cyclone separator may be in fluid communication with the first collector and the second collector, and the second collector may be in fluid communication with the compressor. The compressor may be configured to continuously provide a circulating fluid to the jet mill, the cyclone separator, and the second collector.

Other embodiments of the methods and systems are described herein. Additional aspects will be set forth in part in the description which follows, and in part will be obvious from the description, or may be learned by practice of the aspects described herein. The advantages described herein may be realized and attained by means of the elements and combinations particularly pointed out in the appended claims. It is to be understood that both the foregoing general description and the following detailed description are exemplary and explanatory only and are not restrictive.

DETAILED DESCRIPTION

Provided herein are methods and systems for grinding a material with a jet mill. The methods and systems provided herein may address one or more of the foregoing disadvantages of current methods and systems of jet milling.

Systems

Provided herein are systems for grinding materials. In some embodiments, the systems include a jet mill, a cyclone separator, a first collector, a second collector, and a compressor. The jet mill may be in fluid communication with the cyclone separator, the first collector, the second collector, and the compressor. For example, the jet mill may be in fluid communication with the cyclone separator, the cyclone separator may be in fluid communication with the first collector and the second collector, the second collector may be in fluid communication with at least one of the compressor or the jet mill, and the compressor is in fluid communication with the jet mill. As a further example, the jet mill may be in fluid communication with the cyclone separator, the cyclone separator may be in fluid communication with the first collector and the second collector, the second collector may be in fluid communication with the compressor, and the compressor is in fluid communication with the jet mill. Such arrangements may form a cycle. That is, a circulating fluid may be recirculated through the system. As used herein, two components are in "fluid communication" with each other when they are directly connected or indirectly connected, via piping and/or other known equipment, in a manner that permits a fluid to flow between the two components, e.g., from one component to the other.

The compressor may be configured to continuously circulate a fluid to the jet mill, the cyclone separator, and the second collector. The circulating fluid may transport a material throughout the system so that the jet mill grinds the material to produce a ground material, which separates via a cyclone separator into portions having different particle sizes that are separately collected by the first collector and the second collector, thereby allowing the at least substantially particle-free circulating fluid to be recycled. For example, the circulating fluid may be used to transport additional particles of a material through the system. A circulating fluid generally may be recirculated through the system throughout a grinding process, and the systems provided herein may be configured to introduce an additional amount of a circulating fluid to compensate for any circulating fluid that escapes a system for any reason. As used herein, the phrase "substantially particle-free" and the like refer to a stream from which at least 99%, by weight, at least 99.5%, by weight, at least 99.9%, by weight, or at least 99.99%, by weight, of a material has been removed from a circulating fluid.

In some embodiments, the systems also include a feed hopper, and a conveyor feeder configured to transport a material from the feed hopper to the jet mill.

Figure 1:
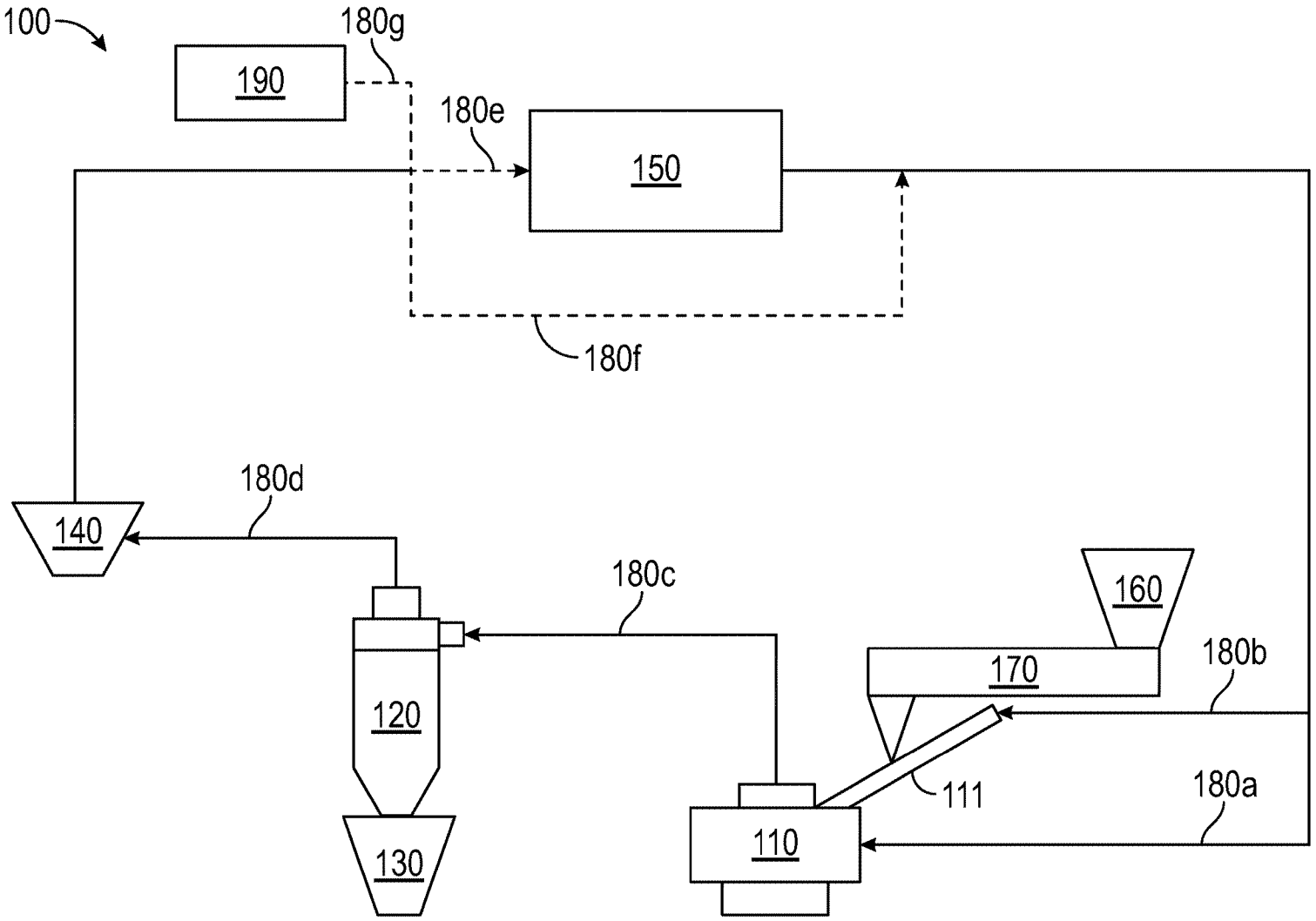
FIG. 1 depicts an embodiment of a system for grinding a material.

An embodiment of a system described herein is depicted at FIG. 1. The system 100 of FIG. 1 includes a jet mill 110 that is in fluid communication with a cyclone separator 120. The cyclone separator 120 is in fluid communication with a first collector 130 and a second collector 140. The second collector 140, as indicated by the dotted lines, may be in fluid communication with other components of the system via a direct connection (180*e*) to the compressor 150, and/or a connection (180*f*) that bypasses the compressor 150. The system 100 of FIG. 1 may optionally include a supplemental fluid source 190, which may be in fluid communication with other components of the system via the connection (180*g*) depicted at FIG. 1. The system 100 of FIG. 1 also includes a feed hopper 160 and a conveyor 170 that feeds a material into the jet mill 110. The compressor 150 pressurizes the circulating fluid (180*a*, 180*b*) flowing to the jet mill 110 and a feed tube assembly 111 of the jet mill 110, respectively. The flow of the circulating medium in feed 180*a* may exceed the flow of the circulating medium in feed 180*b*. For example, feed 180*a* may have a flow sufficient to impart an appropriate pressure to the grinding chamber of the jet mill 110, while feed 180*b* may have a flow sufficient, but less in total than the flow to feed 180*a*, to operate the feed tube assembly 111 of the jet mill to allow the uninhibited transport of particles to the grinding chamber of the jet mill 110. The feed tube assembly 111 of the jet mill 110 receives a material provided by the conveyor 170 onto which the material is disposed by the feed hopper 160. The circulating fluid 180*c* transports the material ground by the jet mill to the cyclone separator 120. The first collector 130 collects a first portion of the ground material, while the circulating fluid 180*d* transports a second portion of the ground material to the second collector 140, which collects the second portion of the ground material. The circulating fluid 180*e*, which is devoid of ground particles, may then be returned to the compressor 150 for re-pressurization prior to being forwarded to the jet mill 110 or jet mill feed tube assembly 111. In some embodiments, at least a portion of the circulating fluid 180*f* may bypass the compressor and be returned to the jet mill 110 or jet mill feeder 111. A supplemental amount of fluid 180*g* may be provided to the system from the supplemental fluid source 190 in order to compensate for a reduction of pressure, a reduction of volume, or a combination thereof of the circulating fluid 180*e* and/or the circulating fluid 180*f*. The supplemental amount of fluid 180*g* that may be provided to the system 100 of FIG. 1 may be adjusted continuously or intermittently.

Jet Mill

As used herein, the phrases "jet mill" and "jet milling" include and refer to the use of any type of fluid energy impact mills, including, but not limited to, spiral jet mills, loop jet mills, and fluidized bed jet mills, with or without internal air classifiers. These mills are known in the art. The jet mill is used to grind particles of a material.

As used herein, the terms "grind", "ground", or "grinding" refers to particle size reduction by fracture, e.g., conventional milling. The process is characterized by the acceleration of particles in a gas stream to high velocities for (i) impingement on other particles, similarly accelerated, (ii) impingement on the walls of the mill, or (iii) a combination thereof.

In some embodiments, jet milling the particles, in addition to providing the desired level of grinding, lowers the residual solvent and moisture levels in the particles while in process (i.e., before collection), due to the use of a dry circulating fluid (e.g., as grinding gas, injection gas, or both). To achieve reduced residual levels, the injection/grinding gas preferably is a low liquid-content gas, such as dry nitrogen, carbon dioxide, or a combination thereof. In some embodiments, the injection/grinding gas is at a temperature less than 100° C. (e.g., less than 75° C., less than 50° C., less than 25° C., etc.), or from about 25° C. to about 100° C. As used herein, the phrase "low liquid-content gas" and the like refer to a gas that includes less than 1%, by volume, less than 0.5%, by volume, less than 0.1%, by volume, or less than 0.01%, by volume, of liquid, such as water.

The jet mills used in the systems and devices described herein generally may include any jet mill configured to reduce an average particle size of a material to produce a ground material.

In some embodiments, the jet mills of the systems and methods described herein include a grinding chamber, a manifold, and a feeder.

The manifold may include at least one first fluid inlet, and the manifold may encircle the grinding chamber. The manifold may entirely or partially encircle the grinding chamber. The grinding chamber and the manifold typically are in fluid communication with each other. In some embodiments, the manifold has one first fluid inlet. In some embodiments, the manifold includes two or more first fluid inlets. When the manifold includes two or more first fluid inlets, the locations of the two or more first fluid inlets may be equidistant from each other. A circulating fluid may be provided to the manifold through the at least one first fluid inlet. The circulating fluid provided to the at least one fluid inlet may be referred to as a "grinding gas."

The feeder of a jet mill, in some embodiments, includes a feed tube assembly. The feed tube assembly may include a hollow body. The hollow body may be a tube, and may be constructed from the same materials as one or more other parts of the jet mill. The hollow body typically is in fluid communication with the grinding chamber of the jet mill. Therefore, a circulating fluid and material disposed in the hollow body may be introduced into the grinding chamber of the jet mill. In some embodiments, the hollow body includes a second fluid inlet and a material inlet. A material may be disposed in the material inlet, and a circulating fluid may be provided to the second fluid inlet. The circulating fluid provided to the second fluid inlet may be referred to as an "injection gas." In some embodiments, the feeder of the jet mill is a venturi-type feeder.

The grinding chambers of the jet mills used in the systems and methods described herein generally may have any diameter. In some embodiments, the diameter of a grinding chamber is about 8 inches (20.32 cm) to about 42 inches (106.68 cm). In some embodiments, the diameter of a grinding chamber is about 8 inches (20.32 cm) to about 36 inches (91.44 cm). In some embodiments, the diameter of a grinding chamber is about 8 inches (20.32 cm) to about 30 inches (76.2 cm). In some embodiments, the diameter of a grinding chamber is about 8 inches (20.32 cm) to about 24 inches (60.96 cm). In some embodiments, the diameter of a grinding chamber is about 10 inches (25.4 cm) to about 24 inches (60.96 cm). In some embodiments, the diameter of a grinding chamber is about 10 inches (25.4 cm) to about 22 inches (55.88 cm). In some embodiments, the diameter of a grinding chamber is about 10 inches (25.4 cm) to about 20 inches (50.8 inches). In some embodiments, the diameter of a grinding chamber is about 10 inches (25.4 cm) to about 18 inches (45.72 cm). In some embodiments, the diameter of a grinding chamber is about 10 inches (25.4 cm) to about 16 inches (40.64 cm). In some embodiments, the diameter of a grinding chamber is about 10 inches (25.4 cm) to about 15 inches (38.1 cm). The grinding chambers may be formed of stainless steel, and may include a liner. Examples of suitable liners include polyethylene, polytetrafluoroethylene, polyurethane, vulcanized rubber, tungsten carbide, etc.

The jet mills of the systems and methods described herein may have a capacity of about 1 kg/hour to about 5,000 kg/hour. The jet mills of the systems and methods described herein may have a capacity of about 3 kg/hour to about 4,600 kg/hour. The jet mills of the systems and methods described herein may have a capacity of about 3 kg/hour to about 4,000 kg/hour. The jet mills of the systems and methods described herein may have a capacity of about 3 kg/hour to about 3,600 kg/hour. The jet mills of the systems and methods described herein may have a capacity of about 3 kg/hour to about 2,800 kg/hour. The jet mills of the systems and methods described herein may have a capacity of about 3 kg/hour to about 2,000 kg/hour. The jet mills of the systems and methods described herein may have a capacity of about 3 kg/hour to about 1,400 kg/hour. The jet mills of the systems and methods described herein may have a capacity of about 3 kg/hour to about 1,000 kg/hour. The jet mills of the systems and methods described herein may have a capacity of about 3 kg/hour to about 700 kg/hour. The jet mills of the systems and methods described herein may have a capacity of about 3 kg/hour to about 475 kg/hour. The jet mills of the systems and methods described herein may have a capacity of about 3 kg/hour to about 150 kg/hour. The jet mills of the systems and methods described herein may have a capacity of about 10 kg/hour to about 120 kg/hour.

The jet mills used in the systems and methods described herein may include commercially available jet mills. For example, the jet mill may include a MICRONIZER® jet mill (Sturtevant, Inc., USA).

Generally, a pressure in a jet mill may be effective to grind a material. In some embodiments, a pressure in the jet mill is about 75 psig to about 200 psig. In some embodiments, a pressure in the jet mill is about 75 psig to about 190 psig. In some embodiments, a pressure in the jet mill is about 75 psig to about 180 psig. In some embodiments, a pressure in the jet mill is about 75 psig to about 170 psig. In some embodiments, a pressure in the jet mill is about 75 psig to about 160 psig. In some embodiments, a pressure in the jet mill is about 75 psig to about 150 psig. In some embodiments, a pressure in the jet mill is about 100 psig to about 200 psig. In some embodiments, a pressure in the jet mill is about 125 psig to about 200 psig. In some embodiments, a pressure in the jet mill is about 150 psig to about 200 psig. The "pressure in the jet mill" is the pressure in the jet mill's grinding chamber. The pressure in a grinding chamber may be applied by a circulating fluid, and, in such instances, the jet mills herein are said to be "pressurized by the circulating fluid."

Conveyor Feeder

In some embodiments, the systems described herein include a conveyor feeder. The conveyor feeder may be configured to dispose a material in a jet mill. For example, the conveyor feeder may dispose a material in a feeder of a jet mill. As a further example, the conveyor feeder may dispose a material in a material inlet of a feeder of a jet mill.

In some embodiments, the conveyor feeder includes a screw conveyor. In some embodiments, the conveyor feeder includes a belt conveyor.

In some embodiments, the conveyor feeder is enclosed in an enclosure. Therefore, the systems described herein may include an enclosure. The enclosure may be configured to receive a positive pressure, which may be provided by the circulating fluid. The enclosure in which the conveyor feeder is disposed generally may be constructed of any material(s), and one or more of the materials may be transparent. The enclosure may include one or more valves to allow the circulating fluid to escape the enclosure.

As used herein, the phrase "positive pressure" generally refers to a pressure that is (i) greater than ambient pressure, (ii) less than the pressure in a grinding chamber of a jet mill, or (iii) a combination thereof. For example, the "positive pressure" that is applied to one or more apparatuses herein may be about 50% to about 99% less than the pressure in a grinding chamber of a jet mill. A positive pressure, therefore, may be sufficient to blanket the contents of an apparatus, such as the material in a feed hopper; or a positive pressure may be sufficient to permeate the contents of an apparatus, such as the material in a feed hopper, with a circulating fluid (or other fluid). The systems provided herein, may include a feature, such as a pressure reducing valve, that is used, in part, to provide a positive pressure with the circulating medium. A fluid other than the circulating fluid, however, may be used to apply a positive pressure to one or more apparatuses. When two or more apparatuses are under a positive pressure, the positive pressures applied to the two or more apparatuses may be the same or different.

The conveyor feeder may be used, at least in part, to control the feed rate at which a material is provided to a jet mill. In some embodiments, the conveyor feeder disposes a material in the feeder of the jet mill at a rate described herein. The feed hopper and the conveyor feeder may be used to control the feed rate at which a material is provided to a jet mill. For example, the feed hopper may control the amount of material deposited onto the conveyor feeder, and the conveyor feeder may control the rate at which the material on or in the conveyor feeder is provided to the jet mill. When the conveyor feeder is a belt conveyor, the feed hopper may be used to control the depth of the material deposited on the belt conveyor.

Not wishing to be bound by any particular theory, it is believed that the average particle size of a first portion of a ground material may be determined, at least in part, by the feed rate at which a material is provided to a jet mill. In some embodiments, the average particle size of a first portion of a ground material is decreased by reducing the feed rate at which a material is provided to a jet mill. Conversely, in some embodiments, the average particle size of a first portion of a ground material is increased by raising the feed rate at which a material is provided to a jet mill.

In some embodiments, the feed rate at which a material is provided to a jet mill is controlled, at least in part, by a conveyor feeder, and the feed rate is selected based on (i) a desired average particle size of a first portion of a ground material, (ii) the capacity of a jet mill, or (iii) a combination thereof.

The feed rate at which a material is provided to a jet mill may be about 1 kg/hour to about 5,000 kg/hour, about 1 kg/hour to about 4,000 kg/hour, about 3 kg/hour to about 3,600 kg/hour, about 3 kg/hour to about 2,800 kg/hour, about 3 kg/hour to about 2,000 kg/hour, about 3 kg/hour to about 1,400 kg/hour, about 3 kg/hour to about 1,000 kg/hour, about 3 kg/hour to about 700 kg/hour, about 3 kg/hour to about 475 kg/hour, about 3 kg/hour to about 200 kg/hour, about 3 kg/hour to about 150 kg/hour, about 10 kg/hour to about 120 kg/hour, about 20 kg/hour to about 80 kg/hour, or about 35 kg/hour to about 50 kg/hour.

Feed Hopper

The systems described herein may include a feed hopper. The feed hopper generally may include a container having a tapered bottom through which a material is discharged. In some embodiments, a feed hopper provides a material to a jet mill, e.g., a material inlet of a jet mill.

In some embodiments, the systems described herein include a conveyor feeder and a feed hopper, and the feed hopper disposes a material on or in the conveyor feeder. The conveyor feeder may be configured to transport a material from the feed hopper to the jet mill. When the systems described herein include a feed hopper and a conveyor feeder, the feed rate at which a material is disposed in a jet mill may be determined, at least in part, by (i) the rate at which the feed hopper disposes a material on a conveyor feeder, (ii) the rate at which the conveyor feeder disposes the material in a jet mill, or (iii) a combination thereof.

A positive pressure may be applied to a feed hopper. In some embodiments, the positive pressure is applied with the circulating fluid.

In some embodiments, the systems provided herein also include a charge hopper, which is configured to provide a material to the feed hopper. The feed hopper and the charge hopper may be directly or indirectly connected. In some embodiments, a positive pressure is applied to the charge hopper. The positive pressure may be applied by a circulating fluid. When a positive pressure of the circulating fluid is applied to a charge hopper, the circulating fluid may permeate through a material in the charge hopper, a feed hopper, or a combination thereof. Not wishing to be bound by any particular theory, it is believed that applying a positive pressure to the charge hopper and/or feed hopper with a desiccated circulating fluid or other oxygen-free fluid may reduce or minimize the water content of a material, such as coal, disposed in the charge hopper and/or feed hopper.

Circulating Fluid

Generally, the circulating fluid used in the methods and systems described herein may include a fluid that is capable of transporting a material through the systems, and applying a pressure (e.g., pressurizing a jet mill, providing a positive pressure, pulsing the bags of a baghouse dust collector, etc.) to one or more of the components of the systems. In some embodiments, the circulating fluid includes an oxygen-free gas. The phrase "oxygen-free gas", as used herein, generally refers to a gas that includes less than 1% oxygen, by volume. In some embodiments, the oxygen-free gas includes less than 0.5% oxygen, by volume. In some embodiments, the oxygen-free gas includes less than 0.1% oxygen, by volume. In some embodiments, the oxygen-free gas includes less than 100 ppmv, less than 10 ppmv, or less than 5 ppmv oxygen.

In some embodiments, the circulating fluid includes an inert gas. The inert gas may be selected from nitrogen ($N_2$), argon (Ar), or a combination thereof. In some embodiments, the circulating fluid is carbon dioxide. In some embodiments, the circulating fluid includes carbon dioxide and an inert gas.

Cyclone Separator

Generally, the cyclone separators of the systems and methods described herein are apparatuses configured to separate a first portion of a ground material and a second portion of a ground material, the first portion of the ground material including particles having a size equal to or greater than a threshold particle size. The cyclone separators may achieve the separation of the first portion and the second portion of the ground material by creating a spiral vortex. The second portion of the ground material, which includes particles having a size less than the threshold particle size, typically has less inertia, and, therefore, is more easily impacted by the forces imparted by the spiral vortex. In contrast, the first portion of the ground material, which includes particles having a size equal to or greater than the threshold particle size, is not as easily impacted by the forces imparted by the spiral vortex.

A cyclone separator may have any spatial orientation. In some embodiments, a cyclone separator is arranged substantially vertically. A cyclone separator is arranged "substantially vertically" when it is arranged so that (i) the longitudinal axis that traverses the center of the cyclone portion of the cyclone separator is substantially vertical, and (ii) its conical section is directed towards the ground, as shown at FIG. 1.

The threshold particle size that distinguishes the first portion and second portion of a ground material may be adjusted. In some embodiments, the threshold particle size is adjusted by modifying a vortex finder of a cyclone separator. Modifying a vortex finder may increase or decrease the forces imparted by a spiral vortex, thereby increasing or decreasing a threshold particle size.

In some embodiments, the threshold particle size is about 0.1 μm to about 30 μm, about 0.1 μm to about 25 μm, about 0.1 μm to about 20 μm, about 0.1 μm to about 15 μm, about 0.1 μm to about 10 μm, about 0.1 μm to about 7 μm, or about 0.1 μm to about 5 μm. In some embodiments, the threshold particle size is about 1 μm to about 30 μm, about 1 μm to about 25 μm, about 1 μm to about 20 μm, about 1 μm to about 15 μm, about 1 μm to about 10 μm, about 1 μm to about 7 μm, or about 1 μm to about 5 μm. In some embodiments, the threshold particle size is about 20 μm. In some embodiments, the threshold particle size is about 15 μm. In some embodiments, the threshold particle size is about 10 μm. In some embodiments, the threshold particle size is about 5 μm. In some embodiments, the threshold particle size is about 4 μm. In some embodiments, the threshold particle size is about 3 μm. In some embodiments, the threshold particle size is about 2 μm. In some embodiments, the threshold particle size is about 1 μm.

The cyclone separator of the methods and systems described herein may be configured to separate from a stream about 90% to 100%, about 92% to 100%, about 94% to 100%, about 96% to 100%, about 98% to 100%, or about 99% to 100%, by weight, of particles having a particle size equal to or greater than a threshold particle size. For example, if a stream includes 100 g of particles having a particle size equal to or greater than a threshold particle size, and a cyclone separator separates 99 g of these particles from the stream, then the cyclone separator is configured to separate from the stream 99%, by weight, of the particles having a particle size equal to or greater than a threshold particle size. Therefore, in some embodiments, the second portion of a ground material may include an amount of particles having a particle size equal to or greater than the threshold particle size. Conversely, in some embodiments, a first portion of a ground material, may include particles having a particle size less than the threshold particle size. Accordingly, the "first portion" and the "second portion" described herein are defined in terms of a stream separated by a cyclone separator having a theoretical ability to separate all of the particles having a particle size equal to or greater than a threshold particle size from all of the particles having a particle size less than the threshold particle size, but it must be noted that no cyclone separator will have this perfect ability. Therefore, the phrase "a first portion of a ground material" encompasses those "first portions" that include [1] X %, by weight, of the particles of an input stream having a particle size equal to or greater than a threshold particle size, wherein the cyclone separator used to isolate the first portion is configured to separate from the input stream X % of particles having a particle size equal to or greater than the threshold particle size, [2] a portion (e.g., about 0.01% to about 10%, 0.01% to about 5%, or about 0.01% to about 1%, by weight) of particles having a particle size less than the threshold particle size, or [3] a combination thereof. Conversely, the phrase "a second portion of a material" encompasses those "second portions" that include (100-X) %, by weight, of the particles of the input stream having a particle size equal to or greater than a threshold particle size.

The cyclone separators used in the systems and methods provided herein may include a commercially-available cyclone separator, such as those sold by FISHER-KLOSTERMAN®, USA.

First Collector

The first collector generally may include any apparatus capable of collecting a first portion of a ground material, the first portion of the ground material including particles having a size equal to or greater than a threshold particle size.

In some embodiments, the first collector is a first hopper. The first hopper may be a container that is capable of discharging its contents at the bottom.

In some embodiments, a cyclone separator separates the first portion of a ground material from a second portion of a ground material, and the first portion of a ground material, which includes particles having a size equal to or greater than a threshold value, is discharged from the bottom of the cyclone separator, when the cyclone separator is arranged vertically. When the cyclone separator is arranged vertically, the first collector may be arranged beneath the cyclone separator. The first collector may be directly or indirectly, e.g., via a pipe, connected to the bottom portion of the cyclone separator.

In some embodiments, a positive pressure is applied to the first collector. The positive pressure may be applied by a circulating fluid. For example, the circulating fluid that traverses the cyclone separator may blanket the ground material in the first collector with the circulating fluid.

Second Collector

The second collector generally may include any apparatus capable of collecting a second portion of a ground material, the second portion of the ground material including particles having a size less than a threshold particle size.

In some embodiments, the second collector includes a second hopper and a baghouse dust collector. The baghouse dust collector may be configured to remove the second portion of the ground material from the circulating fluid. The second portion of the ground material that is separated by the baghouse dust collector may be disposed in the second hopper. A positive pressure may be applied to the baghouse dust collector, the second hopper, or both the baghouse dust collector and the second hopper, and the positive pressure may be provided by the circulating fluid.

In some embodiments, the baghouse dust collector is a reverse pulse-jet baghouse. In the reverse pulse-jet baghouses, the bags may be cleaned, i.e., pulsed, by the circulating fluid. The circulating fluid, for example, may be accelerated through a nozzle mounted in the reverse pulse-jet baghouse.

When the second collector includes a baghouse dust collector, the baghouse dust collector may include a burst disc. The burst disc may offer protection again overpressurization.

In some embodiments, the systems provided herein include one or more valves configured to prevent or reduce the propagation of an explosion that originates in or is caused by a baghouse dust collector. The one or more valves may include a VALVEX® explosion isolation valve (FIKE®, USA). In some embodiments, the systems provided herein include two explosion isolation valves, the first being arranged at a position "before" the second collector, and the second being arranged at a position "after" the second collector. In other words, a stream from a cyclone separator would pass through the first explosion isolation valve before entering the second collector, and the stream exiting the second collector would pass through the second explosion isolation valve before encountering another component of the system.

In some embodiments, the systems described herein include a particle sensor, which is commonly referred to as a "bag break sensor" or "broken bag sensor." The particle sensor may be arranged at a position "after" the second collector, and may be configured to detect particle concentration in the stream after the stream has passed through the second collector. If the particle concentration exceeds a predetermined particle concentration threshold, then the system may be configured to cease operating. For example, if a stream is not substantially particle-free "after" the second collector, then this condition may be detected by a particle sensor.

Figure 2:
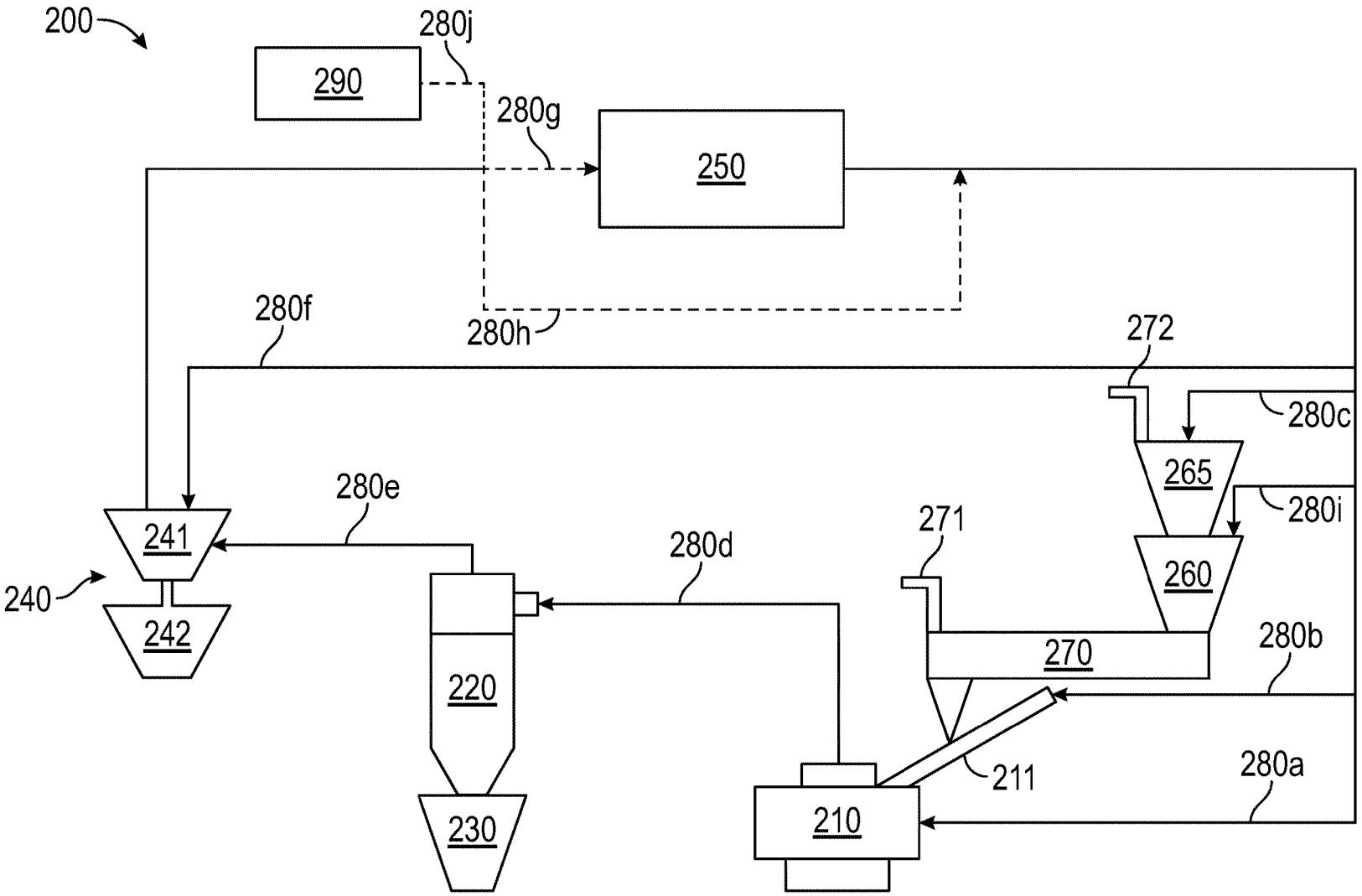
FIG. 2 depicts an embodiment of a system for grinding a material.

An embodiment of a system described herein is depicted at FIG. 2. The system 200 of FIG. 2 includes a jet mill 210 that is in fluid communication with a cyclone separator 220. The cyclone separator 220 is in fluid communication with a first collector 230 and a second collector 240. The second collector 240, as indicated by the dotted lines, may be in fluid communication with other components of the system via a direct connection 280*g* to the compressor 250, and/or a connection 280*h* that bypasses the compressor 250. The system 200 of FIG. 2 may optionally include a supplemental fluid source 290, which may be in fluid communication with other components of the system via the connection (280*j*) depicted at FIG. 2. The system 200 of FIG. 2 also includes a charge hopper 265, a feed hopper 260, and a conveyor 270 that feeds a material into the jet mill 210. The compressor 250 pressurizes the circulating fluid (280*a*, 280*b*) flowing to the jet mill 210 and a feed tube assembly 211 of the jet mill 210, respectively. The flow of the circulating medium in feed 280*a* may exceed the flow of the circulating medium in feed 280*b*. For example, feed 280*a* may have a flow sufficient to impart an appropriate pressure to the grinding chamber of the jet mill 210, while feed 280*b* may have a flow sufficient, but less in total than the flow to feed 280*a*, to operate the feed tube assembly 211 of the jet mill to allow the uninhibited transport of particles to the grinding chamber of the jet mill 210. The compressor 250 also may provide a positive pressure with the circulating medium (280*c*, 280*i*) to the charge hopper 265 and the feed hopper 260, respectively. The positive pressure of the circulating medium (280*c*, 280*i*) may be utilized to traverse flow through the charge hopper 265 and the feed hopper 260, respectively, to lower the residual solvent and/or moisture levels in the material before the material is fed into the system 200. The use of a dry circulating fluid (e.g., as grinding gas, injection gas, or both) in this manner may promote the evaporation of surface-adhered fluid into the traversing gas, and the fluid-laden vapor may then be vented via valves (271, 272). To achieve reduced residual levels, the injection/grinding gas preferably may be a low liquid-content gas, such as dry nitrogen, carbon dioxide, or a combination thereof.

The feed tube assembly 211 of the jet mill 210 receives a material provided by an enclosed conveyor 270 onto which the material is disposed by the feed hopper 260. The circulating fluid 280*d* transports the material ground by the jet mill to the cyclone separator 220. The first collector 230 collects a first portion of the ground material, while the circulating fluid 280*e* transports a second portion of the ground material to the second collector 240, which collects the second portion of the ground material. The second collector 240 includes a baghouse dust collector 241 and a hopper 242. A feed 280*f* of the circulating medium is provided to the baghouse dust collector 241 to pulse the bags of the baghouse dust collector 241. The circulating fluid 280*g*, devoid of particles (e.g., substantially particle-free), may then be returned to the compressor 250 prior to being forwarded to the jet mill 210, jet mill feeder 211, charge hopper 265, feed hopper 260, and/or baghouse dust collector 241. All or a portion of the circulating fluid 280*h* may bypass the compressor and be returned to the jet mill 210, jet mill feeder 211, charge hopper 265, feed hopper 260, and/or baghouse dust collector 241. A supplemental amount of fluid 280*j* may be provided to the system from the supplemental fluid source 290 in order to compensate for a reduction of pressure, a reduction of volume, or a combination thereof of the circulating fluid 280*g* and/or the circulating fluid 280*h*. The supplemental amount of fluid 280*j* that may be provided to the system 200 of FIG. 2 may be adjusted continuously or intermittently.

Compressor

The compressor of the systems and methods described herein generally may be any apparatus effective to pressurize a jet mill, circulate a circulating fluid, or a combination thereof. The compressor may be an apparatus effective to apply a positive pressure to one or more components of a system described herein, including, but not limited to, a charge hopper, a feed hopper, an enclosure in which a conveyor is disposed, a second collector, etc. The systems provided herein may include more than one compressor. For example, a first compressor may be configured to pressurize a jet mill and circulate a circulating fluid, and a second compressor may be configured to apply a positive pressure to one or more components of a system.

In some embodiments, a compressor includes a vaporizer, a cooling unit, or a combination thereof. In some embodiments, a vaporizer, a cooling unit, or a combination thereof may be included in an apparatus other than the compressor. The vaporizer may be configured to convert the make-up circulating fluid from the liquid phase to a gas phase. The cooling unit may be used to limit heat build-up in the compressor system, reduce the temperature of recycled circulating fluid, promote the desiccation of recycled circulating fluid, or a combination thereof.

The compressors may include one or more sensors. A sensor, for example, may be used to detect unacceptable levels of impurities in the circulating fluid. As a further example, a sensor may be used to detect whether a circulating fluid includes an undesirable amount of water, which may include any amount of water beyond a de minimis water content. In some embodiments, the compressors include a sensor for detecting the inert gas concentration and/or a sensor for detecting $O_2$ concentration of the circulating medium. In some embodiments, the systems described herein are configured to stop operating if the sensor detects that the inert gas concentration is insufficient (e.g., greater than 90%) or the sensor detects that the $O_2$ concentration exceeds a predetermined threshold (e.g., greater than 10%). For example, the systems described herein may be configured to halt a conveyor, reduce pressure in a jet mill, cease the circulation of the circulating medium, or a combination thereof when an $O_2$ concentration exceeds a predetermined threshold.

The systems described herein may include a valving, which may be used to vent the systems. In some embodiments, the valving is arranged in the systems at a location between the compressor and the second collector.

The systems described herein may include a relief valve (e.g., a LESER™ safety valve). The relief valve may be set at any desirable pressure. In some embodiments, the relief valve is arranged in the systems at a location between the compressor and the second collector.

A circulating fluid may be received and/or stored in a liquid phase. In some embodiments, the compressor includes a vaporizer, the circulating fluid is in a liquid phase when provided to the compressor, and the vaporizer converts the circulating fluid from the liquid phase to a gas phase. The gas phase then may be provided to the systems described herein or used in the methods described herein as a circulating fluid. In some embodiments, the circulating fluid includes one or more components in a liquid phase and one or more components in a gas phase.

The compressor may be configured to provide the circulating fluid to the systems described herein at any desired rate. The rate may be impacted by the pressure applied to one or more components, the capacity of the jet mill, etc.

Material

As used herein, the term "material" may include any material that may be subjected to grinding in a jet mill, including, but not limited to, organic materials, inorganic materials, or combinations thereof. In some embodiments, the material includes an organic material. As used herein, the phrase "organic material" refers to any material including one or more chemical compounds that include carbon. In some embodiments, the material includes an inorganic material. Non-limiting examples of inorganic materials include minerals, metals, oxides, etc.

The material that is subjected to jet milling in the systems and methods described herein generally may include any material in particulate form. The particles of a material may include granules, fibers, flakes, spheres, powders, platelets, other shapes and forms known to persons skilled in the art, or a combination thereof. The particles of a material may be regularly shaped (e.g., substantially spherical), irregularly shaped, or a combination thereof.

The particles of a material fed into the jet mill before jet milling may have an average particle size of about 0.5 mm to about 5 mm. In some embodiments, the particles of a material have an average particle size of about 0.75 mm to about 2 mm. In some embodiments, the particles of a material have an average particle size of about 0.75 mm to about 1.5 mm. In some embodiments, the particles of a material have an average particle size of about 1 mm to about 1.5 mm. In some embodiments, the particles of a material have an average particle size of about 1.25 mm to about 1.5 mm.

The phrase "average particle size", as used herein, refers to the equivalent sphere diameter of the particles, as measured by a light scattering particle size analyzer, such as a BECKMAN COULTER™ LS 13 320 XR Particle Size Analyzer (BECKMAN COULTER™, USA).

In some embodiments, the organic material includes coal. In some embodiments, the coal includes anthracite coal, bituminous coal, sub-bituminous coal, a low-rank coal, or a combination thereof. In some embodiments, the organic material includes coal, lignite, tar sand, and oil shale, or a combination thereof.

When the organic material includes coal, the coal generally may have any ash content. In some embodiments, the ash content of the coal is about 5% to about 20%, by weight, of the coal. In some embodiments, the ash content of the coal is less than or equal to about 2%, by weight, of the coal. In some embodiments, the coal is a "run-of-mine" coal, which may have a relatively high ash content, e.g., about 40%, by weight, of the coal.

When the organic material includes coal, the coal, in some embodiments, has a water content less than 8%, by weight, of the coal. In some embodiments, the coal has a water content of about 2% to about 7%, about 2% to about 6%, about 2% to about 5%, about 3% to about 5%, or about 3% to about 4%, by weight, of the coal.

In some embodiments, the organic material includes cellulose. In some embodiments, the organic material includes an edible organic material. Non-limiting examples of organic materials include one or more flours (e.g., wood flour, pea flour, rye flour), corn starch, etc.

Ground Material

The ground material produced by the systems and methods described herein generally may have an average particle size that is less than the average particle size of the material provided to a jet mill.

In some embodiments, the average particle size of the material before milling is about 5× to about 350× greater than the average particle size of the ground material. In some embodiments, the average particle size of the material before milling is about 5× to about 300× greater than the average particle size of the ground material. In some embodiments, the average particle size of the material before milling is about 100× to about 300× greater than the average particle size of the ground material. In some embodiments, the average particle size of the material before milling is about 100× to about 250× greater than the average particle size of the ground material. In some embodiments, the average particle size of the material before milling is about 150× to about 200× greater than the average particle size of the ground material.

In some embodiments, the average particle size of the material before milling is about 5× to about 350× greater than the average particle size of the first portion of the ground material. In some embodiments, the average particle size of the material is about 5× to about 300× greater than the average particle size of the first portion of the ground material. In some embodiments, the average particle size of the material is about 100× to about 300× greater than the average particle size of the first portion of the ground material. In some embodiments, the average particle size of the material is about 100× to about 250× greater than the average particle size of the first portion of the ground material. In some embodiments, the average particle size of the material is about 150× to about 200× greater than the average particle size of the first portion of the ground material.

In some embodiments, the first portion of the ground material has an average particle size of about 5 μm to about 100 μm. In some embodiments, the first portion of the ground material has an average particle size of about 5 μm to about 75 μm. In some embodiments, the first portion of the ground material has an average particle size of about 5 μm to about 50 μm. In some embodiments, the first portion of the ground material has an average particle size of about 5 μm to about 40 μm. In some embodiments, the first portion of the ground material has an average particle size of about 5 μm to about 30 μm. In some embodiments, the first portion of the ground material has an average particle size of about 5 μm to about 25 μm. In some embodiments, the first portion of the ground material has an average particle size of about 5 μm to about 20 μm. In some embodiments, the first portion of the ground material has an average particle size of about 5 μm to about 15 μm.

In some embodiments, the first portion of the ground material is present in the ground material at an amount of about 90% to about 99%, by weight of the ground material. In other words, about 90% to about 99%, by weight, of the ground material has a particle size equal to or greater than a threshold particle size. In some embodiments, the first portion of the ground material is present in the ground material at an amount of about 92% to about 99%, by weight of the ground material. In some embodiments, the first portion of the ground material is present in the ground material at an amount of about 94% to about 99%, by weight of the ground material. In some embodiments, the first portion of the ground material is present in the ground material at an amount of about 96% to about 99%, by weight of the ground material. In some embodiments, the first portion of the ground material is present in the ground material at an amount of about 98% to about 99%, by weight of the ground material. In some embodiments, the first portion of the ground material is present in the ground material at an amount of about 99% to 100%, by weight of the ground material.

A ground material may have a water content that is less than the water content of the corresponding material prior to jet milling. In some embodiments, the water content of the material is reduced about 25% to about 90%, about 40% to about 90%, about 50% to about 90%, or about 60% to about 90%. For example, if the water content of a material is 6%, and the water content is reduced 50% when the material is jet milled, then the ground material has a water content of 3%.

Methods

The methods provided herein generally include disposing a material in a jet mill to produce a ground material. In some embodiments, the methods provided herein include providing a system as described herein, circulating a circulating fluid through the system with the compressor; and disposing particles of the material in the jet mill.

In some embodiments, the methods include disposing in a grinding chamber of a jet mill a first stream to produce a second stream. The first stream may include (i) a circulating fluid and (ii) particles of a material. The second stream may include (a) the circulating fluid and (b) a ground material. The jet mill in which the first stream is disposed may be pressurized by the circulating fluid.

The first stream generally may be disposed in the grinding chamber of the jet mill by any known technique. In some embodiments, the disposing of the first stream in the grinding chamber of the jet mill includes disposing the material in a material inlet of a feeder of a jet mill, and disposing the circulating fluid in the grinding chamber and the feeder, such as a feed tube assembly, via the at least one first fluid inlet and the second fluid inlet, respectively. In some embodiments, the disposing of the first stream in the grinding chamber of the jet mill includes providing a feed hopper including the material, disposing the material onto a conveyor feeder configured to dispose the material in the material inlet of the feeder of the jet mill, and disposing the circulating fluid in the grinding chamber and the feeder via the at least one first fluid inlet and the second fluid inlet, respectively.

In some embodiments, particles of a material are disposed in a material inlet of a feed tube assembly of the jet mill, and the circulating fluid may be used to transport the particles of the material from the feed tube assembly to the grinding chamber. In some embodiments, a first portion of the circulating fluid is introduced to a feed tube assembly of a jet mill, and a second portion of the circulating fluid is introduced to a grinding chamber of a jet mill, e.g., via a first fluid inlet as described herein.

The phrase "first stream", as used herein, is intended to refer to the stream that includes the circulating fluid and particles in a feeder of a jet mill, the stream that is created when the particles transported into a grinding chamber contact the portion of the circulating fluid introduced to the jet mill via one or more first fluid inlets, or a combination thereof.

In some embodiments, the disposing of the first stream in the grinding chamber of the jet mill includes providing a feed hopper that includes the material, and disposing the material onto a conveyor feeder configured to dispose the material in the feeder of the jet mill.

The conveyor feeder, in some embodiments, is disposed in an enclosure. Therefore, the methods provided herein, in some embodiments, include applying to the enclosure a positive pressure with the circulating fluid. In some embodiments, a positive pressure is applied to the conveyor feeder with a fluid other than the circulating fluid. For example, a separate fluid source may be used to provide a positive pressure to the conveyor feeder. The separate source may include, for example, a nitrogen gas source, or other oxygen-free gas source.

In some embodiments, the methods described herein include applying a positive pressure to a feed hopper. The positive pressure may be applied with a circulating fluid properly desiccated by a cooling unit of a compressor. In some embodiments, a positive pressure is applied to the feed hopper with a fluid other than the circulating fluid. For example, a separate fluid source may be used to provide a positive pressure to the feed hopper. The separate source may include, for example, a nitrogen gas source, or other oxygen-free gas source. The feed hopper and the enclosure in which the conveyor is disposed may be connected; therefore, a single fluid feed may provide a positive pressure to both the feed hopper and the enclosure in which the conveyor is disposed.

In some embodiments, the methods described herein include applying a positive pressure to a charge hopper. The positive pressure may be applied with the circulating fluid. In some embodiments, a positive pressure is applied to the charge hopper with a fluid other than the circulating fluid. For example, a separate fluid source may be used to provide a positive pressure to the charge hopper. The separate source may include, for example, a nitrogen gas source, or other oxygen-free gas source. The charge hopper may be connected to at least one of the feed hopper and the enclosure in which the conveyor is disposed; therefore, a single fluid feed may provide a positive pressure to the charge hopper and at least one of the feed hopper and the enclosure in which the conveyor is disposed.

If a material, such as coal, has a water content that exceeds a particular threshold, then a desiccated fluid may be used to apply a positive pressure to the charge hopper and/or feed hopper may be allowed to permeate the material therein until the water content is reduced to a desirable level. After the water content is reduced to a desirable level, then the material may be fed, via a conveyor feeder or otherwise, into a jet mill. In some embodiments, the methods described herein include applying a positive pressure to at least one of a charge hopper and/or feed hopper, and allowing a desiccated fluid with which the positive pressure is applied to permeate the material for a time effective to reduce the water content of the material to a desirable level.

In some embodiments, the second stream is forwarded to a cyclone separator, including a cyclone separator described herein. The cyclone separator may be configured to separate a first portion of the ground material from a second portion of the ground material. The first portion of the ground material may include particles having a size equal to or greater than a threshold particle size. The second portion of the ground material may include particles having a size less than a threshold particle size.

In some embodiments, the methods include collecting the first portion of the ground material in a first collector.

In some embodiments, the cyclone separator is arranged vertically, the first collector is arranged beneath the cyclone separator, and the first portion of the ground material is deposited in the first collector, due, at least in part, to the fact that the particles of the first portion of the ground material have a size and/or mass that is not influenced, or less influenced, by the forces imparted by the cyclone separator.

In some embodiments, the methods described herein include applying a positive pressure to the first collector. The positive pressure may be applied by the circulating medium, or another oxygen-free fluid source may be used to apply the positive pressure to the first collector. In some embodiments, the circulating fluid that traverses the cyclone separator blankets and/or permeates the contents of the first collector.

In some embodiments, the methods include forwarding to a second collector a third stream that includes (1) the circulating fluid and (2) the second portion of the ground material. The second collector may include an apparatus as described herein, such as an apparatus that includes a baghouse dust collector and a second hopper.

In some embodiments, the methods described herein include applying a positive pressure to the second collector, especially the second hopper. The positive pressure may be applied by the circulating medium, or other oxygen-free fluid source. In some embodiments, the second collected includes a baghouse dust collector, and the methods described herein include cleaning, i.e., pulsing, the bags of the baghouse dust collector with the circulating fluid. In some embodiments, the bags of the baghouse dust collector are pulsed with a fluid other than the circulating fluid.

In some embodiments, the collecting of the second portion of the ground material in the second collector produces a fourth stream that includes the circulating fluid.

The fourth steam then may be recycled. For example, the fourth stream may be contacted with additional particles of the material to produce a fifth stream that includes (i) the circulating fluid and (ii) the additional particles of the material. In some embodiments, the contacting of the fourth stream with additional particles occurs in a grinding chamber of a jet mill, a feeder of a jet mill, or a combination thereof. In some embodiments, the combining of the fourth stream with additional particles of the material to produce the fifth stream includes combining, before a compressor, the fourth stream with an additional amount of circulating medium provided by the vaporization of liquid medium supplied to a compressor from bulk storage for replenishing any losses of the circulating medium, and then contacting the fourth stream with additional particles of a material. In some embodiments, the combining of the fourth stream with additional particles of the material to produce the fifth stream includes forwarding the fourth stream to an inlet (e.g., at least one first fluid inlet and/or second fluid inlet) of a jet mill, wherein the fourth stream contacts additional particles of a material.

The contacting of the fourth stream with additional particles of the material may occur at any location of the systems described herein. In some embodiments, the contacting of the fourth stream with additional particles of the material may occur in the jet mill. The contacting may occur in a feed tube assembly of the jet mill, a grinding chamber of a jet mill, or a combination thereof. For example, a conveyor feeder may dispose additional particles of the material in a material inlet of a feed tube assembly of a jet mill, the fourth stream may be disposed in the second fluid inlet of the feeder, and the fourth stream contacts the additional particles of the material in the hollow body of the feeder of the jet mill. Since a jet mill includes a first fluid inlet, which provides fluids to a manifold and grinding chamber, and a second fluid inlet, which provides fluids to a feed tube assembly of the jet mill, the fourth stream may be provided to the first fluid inlet, the second fluid inlet, or a combination thereof. Therefore, the contacting of the fourth stream with additional particles of the material may occur in a grinding chamber (when at least a portion of a fourth stream is provided to the first fluid inlet), a feeder of a jet mill (when at least a portion of a fourth stream is provided to a second fluid inlet), or a combination thereof.

Generally, the methods described herein may include providing a circulating medium with a compressor. In some embodiments, the circulating medium is received and/or stored in a liquid phase, and the methods described herein include vaporizing the circulating medium, and introducing the circulating medium into a system described herein.

The methods described herein also may include replenishing an amount of circulating medium. A portion of the circulating medium may escape the systems described herein for one or more reasons. For example, the circulating fluid may be used to apply a positive pressure to one or more of a feed hopper, a conveyor feeder, a first collector, a second collector, or a combination thereof, and if any one or more of these apparatuses includes a vent, some of the circulating medium may escape. The circulating medium, therefore, may be replenished at regular intervals throughout a method, continuously throughout a method, in response to one or more events, which may be detected by one or more sensors, or a combination thereof.

The present disclosure is further illustrated by the following non-limiting embodiments. In view of these non-limiting embodiments, other aspects will be apparent to those skilled in the art from consideration of the specification and practice of the subject matter disclosed herein.

Embodiment 1. A method of grinding one or more substances, the method comprising disposing in a grinding chamber of a jet mill a first stream comprising (i) a circulating fluid and (ii) particles of a material to produce a second stream comprising (a) the circulating fluid and (b) a ground material, wherein the jet mill is pressurized by the circulating fluid; and forwarding the second stream to a cyclone separator, wherein the cyclone separator is configured to separate a first portion of the ground material from a second portion of the ground material, wherein the first portion of the ground material includes particles having a particle size equal to or greater than a threshold particle size, and the second portion of the material includes particles having a particle size less than the threshold particle size; collecting the first portion of the ground material in a first collector.

Embodiment 2. The method of Embodiment 1, further comprising forwarding to a second collector a third stream comprising (1) the circulating fluid and (2) the second portion of the ground material, wherein the second collector is configured to separate the second portion of the ground material from the third stream to produce a fourth stream comprising the circulating fluid; and contacting the fourth stream with additional particles of the material to produce a fifth stream.

Embodiment 3. The method of Embodiment 1 or 2, wherein the circulating fluid comprises an oxygen-free gas.

Embodiment 4. The method of any one of Embodiments 1 to 3, wherein the circulating fluid comprises nitrogen gas, carbon dioxide, or a combination thereof.

Embodiment 5. The method of any one of embodiments 1 to 4, wherein the circulating fluid includes an inert gas.

Embodiment 6. The method of Embodiment 5, wherein the inert gas is selected from nitrogen ($N_2$), argon (Ar), or a combination thereof.

Embodiment 7. The method of any one of Embodiments 1 to 6, wherein the circulating fluid includes carbon dioxide and an inert gas.

Embodiment 8. The method of any one of Embodiments 1 to 7, wherein the material comprises an organic material.

Embodiment 9. The method of any one of Embodiments 1 to 8, wherein the material comprises an inorganic material.

Embodiment 10. The method of any one of Embodiments 1 to 9, wherein the material includes minerals, metals, oxides, or a combination thereof.

Embodiment 11. The method of any one of Embodiments 1 to 10, wherein the material comprises coal.

Embodiment 12. The method of any one of Embodiments 1 to 11, wherein the material includes coal having an ash content of about 5% to about 20%, by weight, of the coal.

Embodiment 13. The method of any one of Embodiments 1 to 12, wherein the material includes coal having an ash content less than or equal to about 2%, by weight, of the coal.

Embodiment 14. The method of any one of Embodiments 1 to 13, wherein the material includes a "run-of-mine" coal, which may have a relatively high ash content, e.g., about 40%, by weight, of the coal.

Embodiment 15. The method of any one of Embodiments 1 to 14, wherein the material includes coal having a water content of less than 8%, by weight, of the coal.

Embodiment 16. The method of any one of Embodiments 1 to 15, wherein the material includes coal having a water content of about 2% to about 7%, about 2% to about 6%, about 2% to about 5%, about 3% to about 5%, or about 3% to about 4%, by weight, of the coal.

Embodiment 17. The method of any one of Embodiments 1 to 16, wherein the material includes coal, and the coal comprises anthracite coal, bituminous coal, sub-bituminous coal, a low-rank coal, or a combination thereof.

Embodiment 18. The method of any one of Embodiments 1 to 17, wherein the material comprises coal, lignite, tar sand, and oil shale, or a combination thereof.

Embodiment 19. The method of any one of Embodiments 1 to 18, wherein the material comprises cellulose.

Embodiment 20. The method of any one of Embodiments 1 to 19, wherein the material includes an edible organic material, such as one or more flours (e.g., wood flour, pea flour, rye flour), corn starch, etc.

Embodiment 21. The method of any one of Embodiments 1 to 20, wherein the particles of the material include granules, fibers, flakes, spheres, powders, platelets, other shapes and forms known to persons skilled in the art, or a combination thereof.

Embodiment 22. The method of any one of Embodiments 1 to 21, wherein the particles of the material are regularly shaped (e.g., substantially spherical), irregularly shaped, or a combination thereof.

Embodiment 23. The method of any one of Embodiments 1 to 22, wherein the particles of the material fed into the jet mill before jet milling have an average particle size of about 0.5 mm to about 5 mm, about 0.75 mm to about 2 mm, about 0.75 mm to about 1.5 mm, about 1 mm to about 1.5 mm, or about 1.25 mm to about 1.5 mm.

Embodiment 24. The method of any one of Embodiments 1 to 23, wherein the disposing of the first stream in the grinding chamber of the jet mill comprises disposing the material in the material inlet of the feed tube assembly, and disposing the circulating fluid in the grinding chamber and the feed tube assembly via the at least one first fluid inlet and the second fluid inlet, respectively.

Embodiment 25. The method of any one of Embodiments 1 to 24, further comprising providing a feed hopper comprising the material; and disposing the material onto a conveyor feeder configured to dispose the material in the material inlet of the feed tube assembly of the jet mill.

Embodiment 26. The method of any one of Embodiments 1 to 25, further comprising applying to the feed hopper a positive pressure with the circulating fluid.

Embodiment 27. The method of any one of Embodiments 1 to 26, wherein the conveyor feeder disposes the material in the feed tube assembly of the jet mill at a rate of about 1 kg/hour to about 5,000 kg/hour, about 1 kg/hour to about 4,000 kg/hour, about 3 kg/hour to about 3,600 kg/hour, about 3 kg/hour to about 2,800 kg/hour, about 3 kg/hour to about 2,000 kg/hour, about 3 kg/hour to about 1,400 kg/hour, about 3 kg/hour to about 1,000 kg/hour, about 3 kg/hour to about 700 kg/hour, about 3 kg/hour to about 475 kg/hour, about 3 kg/hour to about 200 kg/hour, about 3 kg/hour to about 150 kg/hour, about 10 kg/hour to about 120 kg/hour, about 20 kg/hour to about 80 kg/hour, or about 35 kg/hour to about 50 kg/hour.

Embodiment 28. The method of any one of Embodiments 1 to 27, wherein a pressure in the jet mill is about 75 psig to about 200 psig, about 75 psig to about 190 psig, about 75 psig to about 180 psig, about 75 psig to about 170 psig, about 75 psig to about 160 psig, about 75 psig to about 150 psig, about 100 psig to about 200 psig, about 125 psig to about 200 psig, or about 90 psig to about 140 psig.

Embodiment 29. The method of any one of Embodiments 1 to 28, wherein the injection/grinding gas is at a temperature less than 100° C., less than 75° C., less than 50° C., or less than 25° C.; or from about 25° C. to about 100° C.

Embodiment 30. The method of any one of Embodiments 1 to 29, wherein the threshold particle size is about 0.1 μm to about 10 μm, about 0.1 μm to about 30 μm, about 0.1 μm to about 25 μm, about 0.1 μm to about 20 μm, about 0.1 μm to about 15 μm, about 0.1 μm to about 10 μm, about 0.1 μm to about 7 μm, about 0.1 μm to about 5 μm, about 1 μm to about 30 μm, about 1 μm to about 25 μm, about 1 μm to about 20 μm, about 1 μm to about 15 μm, about 1 μm to about 10 μm, about 1 μm to about 7 μm, about 1 μm to about 5 μm, about 20 μm, about 15 μm, about 10 μm, about 5 μm, about 4 μm, about 3 μm, about 2 μm, or about 1 μm.

Embodiment 31. The method of any one of Embodiments 1 to 30, wherein the first portion of the ground material has an average particle size of about 5 μm to about 100 μm, about 5 μm to about 75 μm, about 5 μm to about 50 μm, about 5 μm to about 40 μm, about 5 μm to about 30 μm, about 5 μm to about 25 μm, about 5 μm to about 20 μm, or about 5 μm to about 15 μm.

Embodiment 32. A system for grinding materials, the system comprising a jet mill configured to reduce an average particle size of a material to produce a ground material, a cyclone separator configured to separate a first portion of the ground material and a second portion of the ground material, wherein the first portion of the ground material includes particles having a size equal to or greater than a threshold particle size, and the second portion of the ground material includes particles having a size less than the threshold particle size; a first collector configured to collect the first portion of the ground material, and a second collector configured to collect the second portion of the ground material, and a compressor.

Embodiment 33. The system of Embodiment 32, wherein the jet mill is in fluid communication with the cyclone separator, the cyclone separator is in fluid communication with the first collector and the second collector, the second collector is in fluid communication with the compressor, and/or the compressor is in fluid communication with the jet mill.

Embodiment 34. The system of Embodiment 32 or 33, wherein the compressor is configured to continuously provide a circulating fluid to the jet mill, the cyclone separator, and the second collector.

Embodiment 35. The system of any one of Embodiments 32 to 34, further comprising a feed hopper; and a conveyor feeder configured to transport a material from the feed hopper to the jet mill.

Embodiment 36. The system of Embodiment 35, further comprising an enclosure in which the conveyor feeder is enclosed.

Embodiment 37. The system of Embodiment 36, wherein the enclosure is configured to receive a positive pressure, such as a positive pressure provided by the circulating fluid.

Embodiment 38. The system of Embodiment 36 or 37, wherein the enclosure comprises one or more vents to allow the circulating fluid to escape the enclosure.

Embodiment 39. The system of any one of Embodiments 35 to 38, wherein the conveyor feeder comprises a screw conveyor.

Embodiment 40. The system of any one of Embodiments 35 to 38, wherein the conveyor feeder comprises a belt conveyor.

Embodiment 41. The system or method of any one of Embodiments 1 to 40, wherein the jet mill comprises a grinding chamber; a manifold comprising at least one first fluid inlet, wherein the manifold encircles the grinding chamber; and a feed tube assembly comprising a hollow body having (i) a second fluid inlet and (ii) a material inlet; wherein the grinding chamber is in fluid communication with the manifold and the hollow body of the feed tube assembly, and the at least one first fluid inlet and the second fluid inlet are configured to provide the circulating fluid to the grinding chamber and the feeder, respectively.

Embodiment 42. The system or method of Embodiment 41, wherein the feed tube assembly is a venturi-type feeder.

Embodiment 43. The system or method of any one of Embodiments 1 to 42, wherein the first collector is a first hopper.

Embodiment 44. The system or method of any one of Embodiments 1 to 43, wherein the cyclone separator is configured to separate from a stream about 90% to 100%, about 92% to 100%, about 94% to 100%, about 96% to 100%, about 98% to 100%, or about 99% to 100%, by weight, of particles having a particle size equal to or greater than a threshold particle size.

Embodiment 45. The system or method of any one of Embodiments 1 to 44, wherein the compressor is configured to continuously circulate a fluid to the jet mill, the cyclone separator, the second collector, or a combination thereof.

Embodiment 46. The system or method of any one of Embodiments 1 to 45, wherein the compressor includes a vaporizer, a cooling unit, or a combination thereof.

Embodiment 47. The system or method of any one of Embodiments 1 to 45, further comprising a vaporizer, a cooling unit, or a combination thereof.

Embodiment 48. The system or method of any one of Embodiments 1 to 47, wherein the compressor includes one or more sensors.

Embodiment 49. The system or method of any one of Embodiments 1 to 48, wherein the jet mill has a capacity of about 1 kg/hour to about 5,000 kg/hour, about 3 kg/hour to about 4,600 kg/hour, about 3 kg/hour to about 4,000 kg/hour, about 3 kg/hour to about 3,600 kg/hour, about 3 kg/hour to about 2,800 kg/hour, about 3 kg/hour to about 2,000 kg/hour, about 3 kg/hour to about 1,400 kg/hour, about 3 kg/hour to about 1,000 kg/hour, about 3 kg/hour to about 700 kg/hour, about 3 kg/hour to about 475 kg/hour, about 3 kg/hour to about 150 kg/hour, or about 10 kg/hour to about 120 kg/hour.

Embodiment 50. The system or method of any one of Embodiments 1 to 49, wherein the second collector comprises a baghouse dust collector.

Embodiment 51. The system or method of any one of Embodiments 1 to 50, wherein the average particle size of the material before milling is about 5× to about 350×, about 5× to about 300×, about 100× to about 300×, about 100× to about 250×, about 150× to about 200×, about 5× to about 350×, about 5× to about 300×, about 100× to about 300×, about 100× to about 250×, or about 150× to about 200× greater than the average particle size of the first portion of the ground material.

Embodiment 52. The system or method of any one of Embodiments 1 to 51, wherein the first portion of the ground material has an average particle size of about 5 μm to about 100 μm, about 5 μm to about 75 μm, about 5 μm to about 50 μm, about 5 μm to about 40 μm, about 5 μm to about 30 μm, about 5 μm to about 25 μm, about 5 μm to about 20 μm, or about 5 μm to about 15 μm.

Embodiment 53. The system or method of any one of Embodiments 1 to 52, wherein the first portion of the ground material is present in the ground material at an amount of about 90% to about 99%, about 90% to about 99%, about 92% to about 99%, about 94% to about 99%, about 96% to about 99%, about 98% to about 99%, or about 99% to 100%, by weight of the ground material.

Embodiment 54. The system or method of any one of Embodiments 1 to 53, wherein the water content of the material is reduced about 25% to about 90%, by weight, about 40% to about 90%, by weight, about 50% to about 90%, by weight, or about 60% to about 90%, by weight.

Embodiment 55. The method of any one of Embodiments 1 to 31 or 41 to 54, wherein the method comprises providing a system of any one of Embodiments 32 to 40.

Embodiment 56. A method of grinding one or more substances, the method comprising providing a system according to any one of Embodiments 32 to 55; circulating the circulating fluid through the system with the compressor; and disposing particles of the material in the jet mill.

The terms "a," "an," and "the" are intended to include plural alternatives, e.g., at least one. For instance, the disclosure of "a circulating fluid", "an organic material," "a cyclone separator," and the like, is meant to encompass one, or combinations of more than one circulating fluid, organic material, cyclone separator, and the like, unless otherwise specified.

In the descriptions provided herein, the terms "includes," "is," "containing," "having," and "comprises" are used in an open-ended fashion, and thus should be interpreted to mean "including, but not limited to." When methods, systems, or devices are claimed or described in terms of "comprising" various components or steps, the methods or systems can also "consist essentially of" or "consist of" the various components or steps, unless stated otherwise.

Various numerical ranges may be disclosed herein. When Applicant discloses or claims a range of any type, Applicant's intent is to disclose or claim individually each possible number that such a range could reasonably encompass, including end points of the range as well as any sub-ranges and combinations of sub-ranges encompassed therein, unless otherwise specified. Moreover, all numerical end points of ranges disclosed herein are approximate. As a representative example, Applicant discloses, in one embodiment, that the threshold particle size is about 1 μm to about 10 μm. This range should be interpreted as encompassing threshold particle sizes of about 1 μm to about 10 μm, and further encompasses "about" each of 2 μm, 3 μm, 4 μm, 5

μm, 6 μm, 7 μm, 8 μm, and 9 μm, including any ranges and sub-ranges between any of these values.

The term "about", as used herein, refers to values that are within 5% of the indicated value. For example, "about 10 μm" would encompass 9.5 μm to 10.5 μm.

Many modifications and other implementations of the disclosure set forth herein will be apparent having the benefit of the teachings presented in the foregoing descriptions and the associated drawings. Therefore, it is to be understood that the disclosure is not to be limited to the specific implementations disclosed and that modifications and other implementations are intended to be included within the scope of the appended claims. For example, one or more features of one embodiment described herein may be incorporated into another embodiment described herein.

The invention claimed is:

1. A method of grinding one or more substances, the method comprising:

disposing in a grinding chamber of a jet mill a first stream comprising (i) a circulating fluid and (ii) particles of a material to produce a second stream comprising (a) the circulating fluid and (b) a ground material, wherein the jet mill is pressurized by the circulating fluid;

forwarding the second stream to a cyclone separator, wherein the cyclone separator is configured to separate a first portion of the ground material from a second portion of the ground material, wherein the first portion of the ground material includes particles having a particle size equal to or greater than a threshold particle size, and the second portion of the material includes particles having a particle size less than the threshold particle size;

collecting the first portion of the ground material in a first collector;

forwarding to a second collector a third stream comprising (1) the circulating fluid and (2) the second portion of the ground material, wherein the second collector is configured to separate the second portion of the ground material from the third stream to produce a fourth stream comprising the circulating fluid; and contacting the fourth stream with additional particles of the material to produce a fifth stream;

wherein the jet mill comprises the grinding chamber; a manifold comprising at least one first fluid inlet, wherein the manifold encircles the grinding chamber; and a feed tube assembly comprising a hollow body having (A) a second fluid inlet and (B) a material inlet;

wherein the grinding chamber is in fluid communication with the manifold and the hollow body of the feed tube assembly;

wherein the disposing of the first stream in the grinding chamber of the jet mill comprises— disposing the particles of the material in the material inlet of the feed tube assembly, and disposing the circulating fluid in the grinding chamber and the feed tube assembly via the at least one first fluid inlet and the second fluid inlet, respectively.

2. The method of claim 1, wherein the circulating fluid comprises an oxygen-free gas.

3. The method of claim 2, wherein the circulating fluid comprises nitrogen gas, carbon dioxide, or a combination thereof.

4. The method of claim 1, wherein the material comprises an organic material.

5. The method of claim 4, wherein the organic material comprises coal.

6. The method of claim 4, wherein the organic material comprises coal, lignite, tar sand, and oil shale, or a combination thereof.

7. The method of claim 4, wherein the organic material comprises cellulose or an edible organic material.

8. The method of claim 1, further comprising:

providing a feed hopper comprising the material; and disposing the material onto a conveyor feeder configured to dispose the material in the material inlet of the feed tube assembly of the jet mill.

9. The method of claim 8, further comprising applying to the feed hopper a positive pressure with the circulating fluid.

10. The method of claim 8, wherein the conveyor feeder disposes the material in the feed tube assembly of the jet mill at a rate of about 1 kg/hour to about 5,000 kg/hour.

11. The method of claim 8, wherein the conveyor feeder is arranged in an enclosure, and the method further comprises applying to the enclosure a positive pressure with the circulating fluid.

12. The method of claim 1, wherein the second collector comprises a baghouse dust collector.

13. The method of claim 1, wherein a pressure in the jet mill is about 75 psig to about 150 psig.

14. The method of claim 1, wherein the material has an average particle size of about 0.75 mm to about 2 mm.

15. The method of claim 1, wherein the threshold particle size is about 0.1 μm to about 10 μm.

16. The method of claim 1, wherein the first portion of the ground material has an average particle size of about 5 μm to about 100 μm.

17. A system for grinding materials, the system comprising:

a jet mill configured to reduce an average particle size of a material to produce a ground material, a cyclone separator configured to separate a first portion of the ground material and a second portion of the ground material, wherein the first portion of the ground material includes particles having a size equal to or greater than a threshold particle size, and the second portion of the ground material includes particles having a size less than the threshold particle size;

a first collector configured to collect the first portion of the ground material, and a second collector configured to collect the second portion of the ground material, and a compressor;

wherein the jet mill is in fluid communication with the cyclone separator, the cyclone separator is in fluid communication with the first collector and the second collector, the second collector is in fluid communication with the compressor, and the compressor is in fluid communication with the jet mill; and wherein the compressor is configured to continuously provide a circulating fluid to the jet mill, the cyclone separator, and the second collector;

wherein the jet mill comprises a grinding chamber; a manifold comprising at least one first fluid inlet, wherein the manifold encircles the grinding chamber; and a feed tube assembly comprising a hollow body having (A) a second fluid inlet and (B) a material inlet; and wherein the grinding chamber is in fluid communication with the manifold and the hollow body of the feed tube assembly, and the at least one first fluid inlet and the second fluid inlet are configured to provide the circulating fluid to the grinding chamber and the feeder, respectively.

18. A method of grinding one or more substances, the method comprising:

providing a system according to claim 17;

circulating the circulating fluid through the system with the compressor; and disposing particles of the material in the jet mill.

* * * * *